US005202184A

United States Patent [19]

Brierre et al.

[11] Patent Number: 5,202,184

[45] Date of Patent: Apr. 13, 1993

[54] METHOD AND APPARATUS FOR PRODUCING PARA-ARAMID PULP AND PULP PRODUCED THEREBY

[75] Inventors: Roland T. Brierre, Richmond, Va.; Stephan C. De La Veaux, Wilmington, Del.; James E. Geary, Jr., Boothwyn, Pa.; Wesley Memeger, Jr., Wilmington, Del.; Michael L. Trancynger, Chesterfield, Va.

[73] Assignee: E. I. Du Pont de Nemours and Company, Wilmington, Del.

[21] Appl. No.: 723,877

[22] Filed: Jul. 1, 1991

Related U.S. Application Data

[62] Division of Ser. No. 358,811, Jun. 5, 1989, Pat. No. 5,028,372.

[51] Int. Cl.[5] ..... D02G 3/00

[52] U.S. Cl. ..... 428/371; 428/359; 428/395; 162/157.3

[58] Field of Search ..... 264/148, 184; 528/384; 428/357, 359, 364, 395, 371; 162/157.3

[56] References Cited

U.S. PATENT DOCUMENTS

| | | | |
|---|---|---|---|
| 3,068,188 | 12/1962 | Beste et al. | 528/348 |
| 3,079,219 | 2/1963 | King | 528/348 |
| 3,884,881 | 5/1975 | Bice et al. | 528/348 |
| 4,081,430 | 3/1978 | Minami et al. | 528/348 |
| 4,118,374 | 10/1978 | Yamazaki et al. | 528/348 |
| 4,297,478 | 10/1981 | Rochina et al. | 528/348 |
| 4,308,374 | 12/1981 | Vollbracht et al. | 528/348 |
| 4,836,507 | 6/1989 | Yang | 264/184 |
| 4,959,453 | 9/1990 | Sweeny | 528/336 |

*Primary Examiner*—Patrick J. Ryan
*Assistant Examiner*—N. Edwards

[57] ABSTRACT

A method for producing para-aramid pulp includes forming a liquid, actively-polymerizing solution and subjecting the solution to orienting flow which produces an optically anisotropic liquid solution with polymer chains oriented in the direction of the flow. When the solution has a viscosity sufficient to maintain the orientation of the polymer chains, the solution is incubated until it gels. The gel is cut transversely at intervals and para-aramid pulp is isolated from the gel. Para-aramid pulp produced by the process can be used similarly to pulp produced from spun fiber.

7 Claims, 3 Drawing Sheets

METHOD AND APPARATUS FOR PRODUCING PARA-ARAMID PULP AND PULP PRODUCED THEREBY

This is a division of application Ser. No. 07/358,811, filed Jun. 5, 1989, now U.S. Pat. No. 5,028,372.

BACKGROUND OF THE INVENTION

The present invention relates to a method and apparatus for producing para-aramid pulp and pulp made thereby.

The industrial demand for para-aramid pulp such as the poly(p-phenylene terephthalamide) pulp sold under the trademark Kevlar ® by E. I. du Pont de Nemours & Co. has been steadily increasing. Due to high temperature stability, strength and wear resistance, para-aramid pulp is increasingly being used in brake linings and gaskets to replace asbestos with its known health risks. Para-aramid pulp is also being used in newly-developed papers, laminates and composites for applications requiring high strength and temperature stability.

Most para-aramid pulp is produced by first spinning oriented, continuous filaments of the para-aramid polymer in accordance with the dry-jet wet spinning process disclosed in U.S. Pat. No. 3,767,756 and then mechanically converting the filaments into pulp. However, the spinning of para-aramids is an expensive and complicated process. To describe the process briefly, the polymer is dissolved in 100% sulfuric acid to produce an optically anisotropic spin dope. The anisotropic spin dope is spun through an air gap under carefully controlled conditions into a coagulation bath. Typically, the spun filaments are also washed and dried before mechanical conversion into pulp. It is also generally necessary to use specialized fiber cutting equipment to cut the continuous filaments into uniform short lengths before pulping.

While attempts have been made to produce para-aramid pulp without first spinning fiber, a commercially feasible process for so producing para-aramid pulp suitable for current end uses has not been developed

SUMMARY OF THE INVENTION

The present invention provides a method for producing para-aramid pulp and novel pulp produced by the method. The method includes forming a liquid, actively-polymerizing solution containing para-aramid polymer chains by contacting with agitation generally stoichiometric amounts of aromatic diacid halide consisting essentially of para-oriented aromatic diacid halide and aromatic diamine consisting essentially of para-oriented aromatic diamine in a substantially anhydrous amide solvent system. In a preferred form of the invention, at least about 80 mole percent of the aromatic diamine is p-phenylene diamine and at least about 80 mole percent of the aromatic diacid halide is terephthaloyl chloride The liquid solution is subjected, when the inherent viscosity of the para-aramid is between about 1 and about 4, to orienting flow which produces an anisotropic liquid solution containing domains of polymer chains within which the para-aramid polymer chains are substantially oriented in the direction of flow. The anisotropic liquid solution is then incubated for at least a duration sufficient for the solution to gel with the incubation being initiated when the solution has a viscosity sufficient to generally maintain the orientation of the polymer chains in the anisotropic solution. The resulting gel is cut at selected intervals transversely with respect to the orientation of the polymer chains in the gel. Para-aramid pulp can then be isolated from the gel.

In accordance with a preferred form of the present invention, orienting flow is provided by extruding the solution through a die to produce an elongated anisotropic solution mass, preferably the extrusion provides a mean shear of less than about 100 $sec^{-1}$. Most advantageously, the mean shear is less than about 50 $sec^{-1}$. In this form of the invention, incubation is performed initially while conveying the the elongated solution mass away from the die at a velocity not less than the velocity of the mass issuing from the die, preferably by depositing the mass onto a generally horizontal surface moving away from the die. It is also preferable to continue incubation after gel formation to increase the inherent viscosity of and/or to promote increased fibril growth in the pulp produced by the method. In the preferred form of the invention employing the extrusion die, the continued incubation is advantageously carried out after the gel has been cut transversely to facilitate storage of the incubating material.

Para-aramid pulp is isolated from transversely cut gel by use of, for example, a pug mill containing an aqueous alkaline solution. In the mill, the gel is neutralized and coagulated and is simultaneously size reduced to produce a pulp slurry from which the pulp is easily recovered.

In accordance with another preferred form of the invention, the die employed in the method for producing para-aramid pulp is a flow orientation apparatus providing an elongational flow path defined by interior surfaces and providing a layer of non-coagulating fluid on the interior surfaces to decrease contact of the actively-polymerizing polymer solution with the interior surfaces and prevent deposits from building up and blocking the flow path. In a flow orientation apparatus in accordance with the invention, the walls which define substantially entirely the elongational flow path are porous.

The method in accordance with the invention produces pulp directly from the polymerization reaction mixture without spinning and eliminates the need for special spinning solvents In accordance with the most preferred form of the invention in which the para-aramid is homopolymer poly(p-phenylene terephthalamide), the only chemicals needed for the method are p-phenylene diamine, terephthaloyl chloride and, for example, N-methyl pyrrolidone and calcium chloride for the amide solvent system. The method is particularly well-suited for continuous pulp production on a commercial scale.

Para-aramid pulp in accordance with the invention consists essentially of pulp-like short fibers comprised of bundles of sub-micron diameter fibrils of para-aramid free of sulfonic acid groups and having an inherent viscosity of between about 2.0 and about 4.5 and having a diameter of between about 1$\mu$ to about 150$\mu$ and a length of between about 0.2 mm and about 35 mm. The pulp has a crystallinity index of less than about 50, a crystallite size of less than about 40 Å and a surface area of greater than about 2 $m^2/g$. Preferably, the sub-micron fibrils consist essentially of poly(p-phenylene terephthalamide). The novel para-aramid pulp produced by the method surprisingly can be used similarly to pulp produced from spun fiber even though the inherent viscosity is lower than commercially-produced pulp from spun fiber.

DETAILED DESCRIPTION OF PREFERRED EMBODIMENTS

Figure 1:
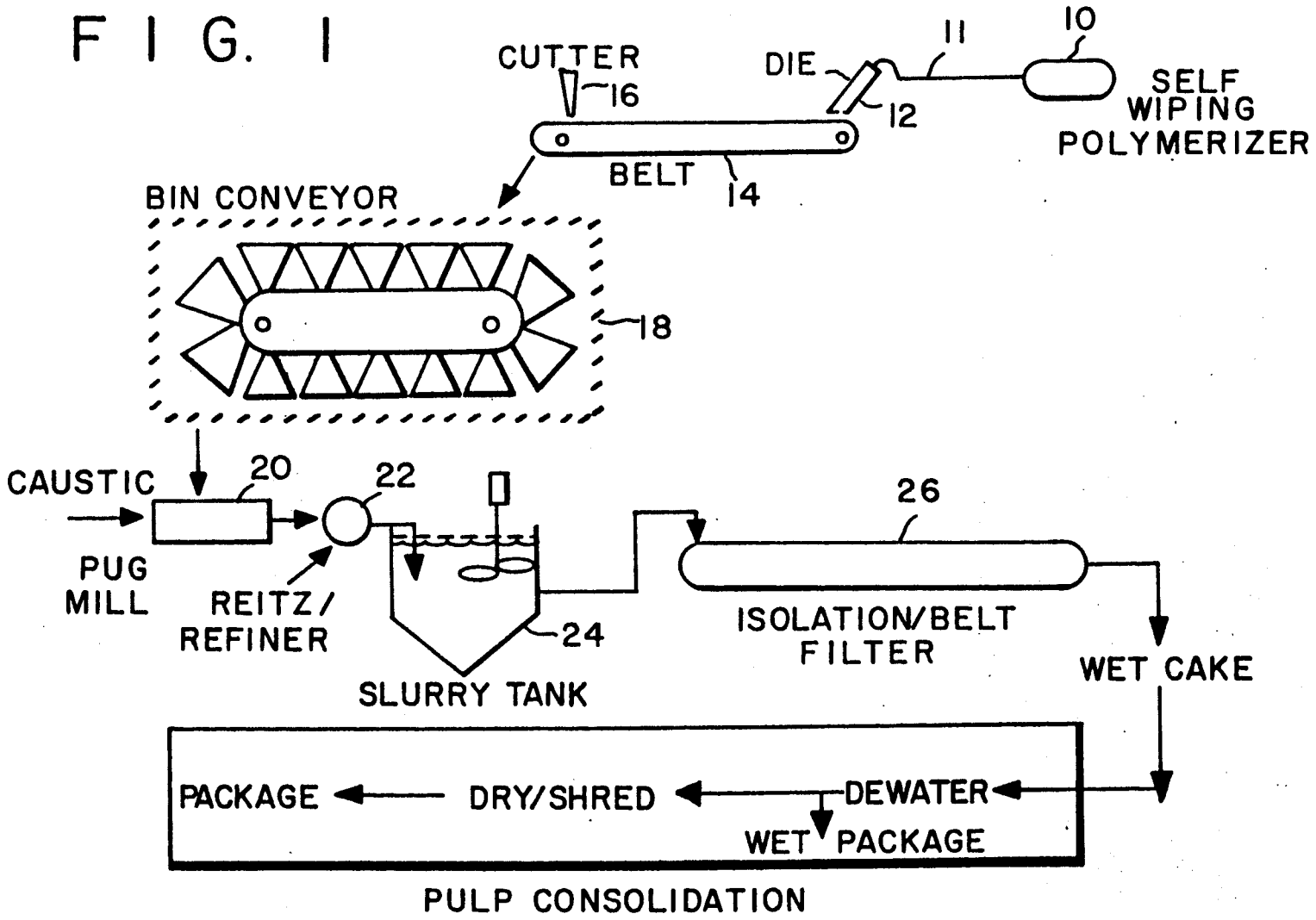
FIG. 1 illustrates diagrammatically a preferred process in accordance with the present invention.

The method in accordance with the invention produces para-aramid pulp. The term para-aramid in the present application is intended to refer to para-oriented, wholly aromatic polycarbonamide polymers and copolymers consisting essentially of recurring units of the formula

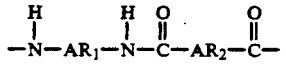

I wherein $AR_1$ and $AR_2$, which may be the same or different, represent divalent, para-oriented aromatic groups. By para-oriented is meant that the chain extending bonds from aromatic groups are either coaxial or parallel and oppositely directed, e.g., substituted or unsubstituted aromatic groups including 1,4-phenylene, 4,4'-biphenylene, 2,6-naphthylene, and 1,5-naphthalene. Substituents on the aromatic groups should be nonreactive and, as will become apparent hereinafter, must not adversely affect the characteristics of the polymer for use in the practice of this invention. Examples of suitable substituents are chloro, lower alkyl and methoxy groups. As will also become apparent, the term para-aramid is also intended to encompass para-aramid copolymers of two or more para-oriented comonomers including minor amounts of comonomers where the acid and amine functions coexist on the same aromatic species, e.g., copolymers produced from reactants such as 4-aminobenzoyl chloride hydrochloride, 6-amino-2-naphthoyl chloride hydrochloride, and the like. In addition, para-aramid is intended to encompass copolymers containing minor amounts of comonomers containing aromatic groups which are not para-oriented, such as, e.g., m-phenylene and 3,4'-biphenylene.

In accordance with the invention, the method for producing para-aramid pulp includes contacting in an amide solvent system generally stoichiometric amounts of aromatic diamine consisting essentially of para-oriented aromatic diamine and aromatic diacid halide consisting essentially of para-oriented aromatic diacid halide to produce a polymer or copolymer in accordance with Formula I above. The phrase "consisting essentially of" is used herein to indicate that minor amounts of aromatic diamines and diacid halides which are not para-oriented and para-oriented aromatic amino acid halides may be employed provided that the characteristics of the resulting polymer for practice of the invention are not substantially altered. The aromatic diamines and aromatic diacid halides and para-oriented aromatic amino acid halides employed in the invention must be such that the resulting polymer has the characteristics typified by para-aramids and forms an optically anisotropic solution in the manner called for in the method of the invention and will cause the polymerization solution to gel when the inherent viscosity of the polymer is between about 1 and about 4.

In accordance with a preferred form of the invention, at least about 80 mole percent of the aromatic diamine is p-phenylene diamine and at least 80 mole percent of the aromatic diacid halide is a terephthaloyl halide, e.g., terephthaloyl chloride. The remainder of the aromatic diamine can be other para-oriented diamines including, for example, 4,4'-diaminobiphenyl, 2-methyl-p-phenylene diamine, 2-chloro-p-phenylene diamine, 2,6-naphthalene diamine, 1,5-naphthalene diamine, 4,4'-diaminobenzanilide, and the like. One or more of such para-oriented diamines can be employed in amounts up to about 20 mole percent together with p-phenylene diamine. The remainder of the aromatic diamine may include diamines which are not para-oriented such as m-phenylene diamine, 3,3'-diaminobiphenyl, 3,4'-diaminobiphenyl, 3,3'-oxydiphenylenediamine, 3,4'-oxydiphenylenediamine, 3,3'-sulfonyldiphenylenediamine, 3,4'-sulfonyldiphenylenediamine, 4,4'-oxydiphenylenediamine, 4,4'-sulfonyldiphenylenediamine, and the like, although it is typically necessary to limit the quantity of such coreactants to about 5 mole percent.

Similarly, the remainder of the diacid halide can be para-oriented acid halides such as 4,4'-dibenzoyl chloride, 2-chloroterephthaloyl chloride, 2,5-dichloroterephthaloyl chloride, 2-methylterephthaloyl chloride, 2,6-naphthalene dicarboxylic acid chloride, 1,5-naphthalene dicarboxylic acid chloride, and the like One or mixtures of such para-oriented acid halides can be employed in amounts up to about 20 mole percent together with terephthaloyl chloride. Other diacid halides which are not para-oriented can be employed in amounts usually not greatly exceeding about 5 mole percent such as isophthaloyl chloride, 3,3'-dibenzoyl chloride, 3,4'-dibenzoyl chloride, 3,3'-oxydibenzoyl chloride, 3,4'-oxydibenzoyl chloride, 3,3'-sulfonyldibenzoyl chloride, 3,4'-sulfonyldibenzoyl chloride, 4,4'-oxydibenzoyl chloride, 4,4'-sulfonyldibenzoyl chloride, and the like.

Again, in the preferred form of the invention up to 20 mole percent of para-oriented amino aromatic acid halides may be used.

In the most preferred form of the invention, p-phenylenediamine is reacted with terephthaloyl chloride to produce homopolymer poly(p-phenylene terephthalamide).

The aromatic diamine and the aromatic diacid halide are reacted in an amide solvent system preferably by low temperature solution polymerization procedures (i.e., under 60° C.) similar to those shown in Kwolek, et al., U.S. Pat. No. 3,063,966 for preparing poly(p-phenylene terephthalamide) and Blades, U.S. Pat. No. 3,869,429. The disclosures of U.S. Pat. Nos. 3,063,966 and 3,869,429 are hereby incorporated by reference. Suitable amide solvents, or mixtures of such solvents, include N-methyl pyrrolidone (NMP), dimethyl acetamide, and tetramethyl urea containing an alkali metal halide. Particularly preferred is NMP and calcium chloride with the percentage of calcium chloride in the solvent being between about 4–9% based on the weight of NMP.

In accordance with the invention, low temperature solution polymerization is preferably accomplished by first preparing a cooled solution of the diamine in the amide solvent containing alkali metal halide. To this solution the diacid halide is preferably added in two stages. In the first stage, the diacid halide is added to the diamine solution cooled to between 0° C. and 20° C. with the mole ratio of acid halide to diamine being between about 0.3 and about 0.5. The resulting low molecular weight "pre-polymer" solution is then cooled to remove the heat of reaction. In the second stage, the remainder of the acid halide is added to the pre-polymer solution while agitating and cooling the solution if desired. For a continuous process, a mixer such as is disclosed in U.S. Pat. No. 3,849,074, the disclosure of which is incorporated herein by reference, is advantageously used for mixing the acid halide into the pre-polymer solution. The second stage polymerization is suitably carried out in an all surface-wiped continuous mixer while cooling the reaction mixture to control the reaction rate. As is known in the art, the reaction mixture is sensitive to moisture and it is desirable to limit exposure to humid air and other sources of water.

In the process of the invention, it is desirable to achieve a carefully controlled reaction rate at least after the inherent viscosity has reached about 1.0. Generally, polymerization catalysts are unnecessary for adequate polymerization and should not be used when they make the reaction rate more difficult to control Nevertheless, the reaction rate must be sufficiently high that the solution gels within a reasonable time after being subjected to orienting flow so that orientation is not lost before gelling as will become more apparent hereinafter, yet should not be so high that it prevents adequate control of the reaction. Typical reaction rates can be such that a time period on the order of 1-10 minutes is required for the thoroughly mixed liquid solution containing all reactants to gel to a "soft" gel. For a continuous process employing an all surfaced-wiped mixer to perform the polymerization, control of the reaction of a solution with a certain concentration of reactants can be performed by adjusting the hold-up time in the mixer and/or the temperature of the solution.

As will become more apparent hereinafter, sufficient quantities of the diamine and diacid are employed in the polymerization so that the concentration of polymer in the resulting actively-polymerizing solution is such that the solution becomes anisotropic upon flow-orienting and ultimately forms a gel through continued polymerization. However, the solubility limits of the reactants in the solvent system should generally not be exceeded. Preferably, quantities of the diamine and diacid are employed which result in a polymer concentration of between about 6% and about 13% by weight.

When the inherent viscosity of the para-aramid polymer is between about 1 and about 4, preferably between about 2 and about 3.5, and while the reaction is still continuing, the solution is subjected to orienting flow which produces an anisotropic solution in which domains of polymer chains are oriented in the direction of flow. For this step of the process, it is advantageous to transfer the actively-polymerizing solution from a polymerizer to apparatus for subjecting the solution to orienting flow. Consequently, since the solution continues to polymerize during the transfer, the transfer should be initiated sufficiently early that the inherent viscosity of the solution is within the proper range when subjected to orienting flow. Moreover, it is generally desirable to initiate the transfer early so that the final inherent viscosity of the pulp does not exceed about 4.5 otherwise the pulp fibers become thicker, coarser and pulp length to diameter ratio (L/D) is decreased. In continuous processes in accordance with the invention, it is desirable for the apparatus employed for flow orientation to be closely-coupled to the polymerizer and receive the solution directly from the polymerizer to minimize the amount and number of surfaces in contact with the solution on which deposits could form.

In accordance with the process of the invention, subjecting the actively-polymerizing solution to orienting flow is performed when the solution is a liquid. At least by the end of this step, the liquid solution is optically anisotropic, i.e., microscopic domains of the solution are birefringent and a bulk sample of the solution depolarizes plane polarized light because the light transmission properties of the microscopic domains of the solution vary with direction. The alignment of the polymer chains within the domains is responsible for the light transmission properties of the solution. As the actively-polymerizing solution is subjected to orienting flow, the polymer chains in the solution become oriented in the direction of flow.

To provide orienting flow, the solution is subjected to flow with generally laminar flow conditions in which the solution undergoes shear or extensional (elongational) flow. While orienting flow can be produced in a variety of different ways, extrusion through a die to form an elongated solution mass is preferred since the use of a die enables the process to be practiced on a continuous basis.

As will become more apparent hereinafter, a die providing shear flow conditions which subjects the solution to a mean shear of less than about 100 $sec^{-1}$ is preferably employed. "Mean shear" as used in this application is intended to refer to the integrated average shear. A low mean shear is advantageous since the velocity of the solution extruded from the die can be low and further advantage is obtained when the mean shear is less than about 50 $sec^{-1}$.

As will be explained in more detail hereinafter, the shape of the solution mass is preferably such that it generally does not flow after forming. To facilitate practice of the invention continuously for volume production, the die produces an elongated solution mass which has a width substantially greater than its thickness. Preferably, the die provides an essentially linear flow path and includes a manifold which provides generally uniform flow across the width of the die.

The most preferred form of the process of the invention employs as a die a flow orientation apparatus having interior surfaces which define an elongational flow path. A layer of non-coagulating fluid is provided on the interior surfaces to decrease contact of the liquid polymer solution with the interior surfaces. Since the actively-polymerizing solution has a propensity to build up and clog an extrusion die, this form of the invention is particularly useful for continuous production of pulp since is can minimize the deposits in the flow path and can assist in enabling the process to run longer periods without interruption.

The non-coagulating fluid can be a liquid or a gas which does not coagulate the solution and which does not adversely affect pulp yield and quality. For ease of providing and controlling the layer of non-coagulating fluid, it is preferable to use a liquid non-coagulating fluid and is particularly useful to use the same liquid solvent system as used in the actively polymerizating solution or a liquid component of the solvent system for the actively-polymerizing solution so that a new fluid is not introduced into the process which would increase the complexity of solvent recovery. For example, when NMP and calcium chloride are the solvent system, NMP and calcium chloride or, even more desirable because of the absence of salts, NMP alone, can be advantageously employed as the non-coagulating fluid.

In the method of the invention, the layer of non-coagulating fluid is sufficiently thick and continuous that it forms and maintains a lubricating "boundary" layer between the interior surfaces of the apparatus and the solution which minimizes the formation of deposits The cross-sectional area of the flow path of the flow orientation apparatus decreases from its inlet to its exit. Due to the lubricating effect of the layer of non-coagulating fluid on the interior surfaces defining the flow path, the orientation of the solution as it moves through the apparatus occurs predominantly due to elongational flow. The elongation rate provided in the apparatus is high enough to produce the orientation in the anisotropic solution necessary to produce pulp. Extremely high elongation rates are unnecessary and should usually be avoided since they increase the complexity of the process and apparatus employed.

The preferred apparatus of the invention provides the layer of coagulating fluid on the interior surfaces by employing porous walls which define substantially entirely the elongational flow path for the solution. The non-coagulating fluid is caused to exude through the porous walls by being supplied under pressure to a conduit in fluid communication with the exterior surfaces of the porous walls. To prevent clogging of the pores of the porous walls, it is necessary for the pressure of the non-coagulating fluid to be in excess of the pressure of the solution moving through the flow path. It is desirable that the pore size of the porous walls be sufficiently small that an amount of the non-coagulating fluid in excess of that required to effectively reduce deposits is not introduced into the actively-polymerizing solution. The porous walls can be suitably produced from sintered metal, such as 316 stainless steel, or porcelain which is resistant to chemical attack by the solution and preferably define a flow path with a linearly-tapering, generally rectangular cross-section.

When an extrusion die such as the flow orientation apparatus is employed in accordance with the invention, the resulting elongated polymer solution mass being extruded from the die is preferably conveyed away at a velocity not less than the velocity of the mass issuing from the die. This can be advantageously accomplished by depositing the elongated mass on a moving generally horizontal surface such as a moving belt. Since the solution is still a liquid, the solution mass should be carried away at a speed at least equivalent to the velocity of the mass issuing from the die so that the orientation within the mass is maintained. It is also necessary that the material flowing onto the belt not be disrupted by too high a belt speed which can adversely affect pulp quality. The die should be positioned in relation to the belt so that there is only a minimal "free-fall" of the solution mass from the die onto the belt which could disturb the orientation of the polymer chains.

For the preferred die defining a linear flow path through the die, the angle of the die flow path in relation to the moving belt is such that the mass is deposited on the belt cleanly without exterior portions of the die adjacent to the die being wet by the solution. In general, to cleanly deposit the solution on the belt, the angle between the belt surface and the flow path should be between about 90° and about 165°. During flow orientation, the temperature should be maintained between about 5° C. and about 60° C. so that the polymerization reaction continues, preferably at a controlled high rate as described previously.

In the process, the oriented anisotropic solution formed during flow orientation is incubated to cause polymerization to continue for at least a duration sufficient for the solution to become a gel. "Incubating" is intended to refer to the maintenance of conditions which result in continued polymerization and/or fibril growth and which maintain the orientation of the oriented anisotropic solution. As will become apparent hereinafter, the conditions for incubation can be varied as the incubation is continued.

The incubation is initiated when the viscosity of the solution is sufficient to generally maintain the orientation of the polymer chains in the anisotropic solution until the liquid solution becomes a gel. The viscosity of the actively-polymerizing solution is therefore in a range such that the orientation of the polymer chains in solution does not greatly relax before the solution gels. The viscosity at the initiation of incubation can vary within a range dependent on the concentration of the polymer in the solution and on the inherent viscosity of the polymer in the solution. It is believed that a suitable viscosity range at the initiation of incubation generally corresponds to the viscosity of a poly(p-phenylene terephthalamide) NMP-$CaCl_2$ solution with a polymer concentration of between about 6 and 13% and having an inherent viscosity of the polymer in the range of about 2 to 4. Preferably, solution viscosities at the initiation of incubation fall with the range of 50 to about 500 poise and most preferably within the range of 150 to 500 poise.

To preserve the orientation of the polymer chains in the solution to the greatest extent, incubation is preferably initiated when the viscosity is sufficiently high that it is very close to the point at which the continuing reaction causes the solution to form a gel. Thus, it is desirable for the solution before incubation to be close to the gel point. This is particularly desirable in the preferred form of the invention where the oriented solution is extruded from the die and is deposited onto a surface for incubation. In this form of the invention, it is desirable that the solution not flow to any great extent after orientation and before gelling which would result in loss of orientation. However, the solution viscosity should not be so high that "fracture" of the solution occurs during flow orienting which can result in poor quality pulp. The temperature during flow orientation can be suitably controlled to adjust the reaction rate to achieve optimum solution viscosities during flow orientation so that the viscosity will be appropriate for the initiation of incubation. In the preferred embodiment employing the extrusion die, a suitable length for the die is selected and/or the die temperature adjusted to extrude the solution at a viscosity suitable for the initiation of incubation.

Incubation is continued at least sufficiently long for gelling to occur. Until the solution gels, it is desirable for the temperature to be between about 25° C. and about 60° C. to maintain a high reaction rate. Most preferably, the temperature is maintained between about 40° C. and about 60° C. until the solution has become a firm gel. Above 40° C. a high reaction rate is achieved and it is believed that, above 40° C., better pulp formation in the gel also results. In the preferred embodiment employing the extrusion die and moving belt, incubation is initiated on the moving belt as the solution is conveyed away from the die and the solution is carried for a sufficient time period so that the solution can gel In order to decrease the time on the belt, the solution on the belt is preferably heated to achieve the above-described temperature range and thus increase the reaction rate so that gelling on the belt occurs typically within a matter of minutes. Preferably, gelling to a hard gel which can be cut as will be described hereinafter occurs within about 2–8 minutes after the initiation of incubation. Before the solution gels and while it is a newly-formed "soft" gel, it is sensitive to moisture and it is desirable to limit exposure to humid air such as by providing a dry inert atmosphere of, for example, nitrogen or argon about the incubating solution.

After gelling, the gel is cut transversely at selected intervals with respect to chain orientation. "Transversely" is intended to refer to any cutting angle which is not parallel to the orientation of polymer chains. The transverse cutting of the gel is performed so that the maximum length of the pulp fibers can be controlled. In addition, it is believed that transverse cutting of the recently-gelled solution results in more uniform pulp fiber lengths and can result in the production of more fibrillated pulp which has a high surface area. In the preferred embodiment employing the extrusion die, cutting in the transverse division is suitably accomplished by cutting the hardened gel into discrete pieces on the belt with a guillotine-like cutter with a cutting stroke ratioed to the belt speed to determine cut length. The cutting of the gel soon after gelling facilitates a continuous process using the extrusion die since the belt length need only be long enough to provide time for the solution to gel. Preferably, the gel is cut at intervals of less than about ½" and is cut when the gel has hardened sufficiently that the gel pieces do not stick together or to the cutter and are not greatly disrupted during normal handling. The temperature during cutting is preferably above about 40° C. to facilitate cutting.

Preferably, incubation is continued after cutting so that the polymerization continues during the continued incubation period to increase the inherent viscosity of the polymer. The length of the continued incubation depends on the length of incubation before cutting. A very short additional incubation may be performed (or even no additional incubation) if the inherent viscosity upon cutting is in the desired range for the pulp to be produced. In the preferred embodiment employing the extrusion die in which it is advantageous to cut the gel soon after extrusion, continued incubation is highly desirable and may be necessary to achieve an inherent viscosity appropriate for the pulp to be produced. In order to minimize the time of the continued incubation, the temperature is preferably maintained at temperatures above room temperature, preferably between 40°–55° C. The time of the continued incubation is variable depending on the product desired but should generally be longer than about 20 minutes at 40°–55° C. when the solution is cut soon after gelling. Continued incubation affects the size distribution of the pulp produced by the method since continued incubation, in conjunction with cutting, increases the average length of the pulp-like short fibers in the pulp to be closer to the cut length of the gel.

In the preferred embodiment of the invention employing the extrusion die, additional incubation can be performed as a separate process step by storing the cut gel pieces at the elevated temperatures and the material can be consolidated in, for example, containers or on a slow moving conveyor, to decrease space requirements during continued incubation. Typically, the hardened gel pieces are stable and there is no need to employ special protective measures other than to prevent contact with water and with humid air during the continued incubation.

Pulp is isolated from the cut gel after incubation. Isolation is accomplished by size reducing the material such as by shredding the gel and by neutralizing and coagulating. In order to facilitate size reduction, size reduction is performed before or, preferably simultaneously with, neutralizing and coagulating. Size reduction, coagulation and neutralization is suitably performed by contacting the gel with an alkaline solution in a mill or grinder, but it may also be useful to use a Reitz refiner at this time. The pulp slurry produced is washed, preferably in stages, to remove the polymerization solvent for later recovery. Solvent can be recovered from both the neutralization solution and the wash water for reuse. The pulp slurry is dewatered such as by vacuum filtration and optionally dried such as in an air-circulation oven to provide the products of various moisture content to meet end-use needs If desired, the pulp can be supplied for end use in wet, uncollapsed, "never-dried" form containing at least about 30% water based on the weight of the dry pulp.

Referring now to the drawings, a typical continuous process in accordance with the invention which is suitable for producing para-aramid pulp commercially is illustrated diagramatically in FIG. 1. After the second stage of the diacid chloride addition to the prepolymer solution, polymerization is performed in a self-wiping polymerizer identified by the reference character 10. The still polymerizing solution is then discharged into a die 12 for orientation. When the solution is extruded from the die 12, the reaction has proceeded so that the inherent viscosity is at the desired level by reaction in the polymerizer 10 and residence time in the die 12. The die 12 subjects the solution to orienting flow which orients the growing polymer chains in the solution in the direction of extrusion.

Figure 2:
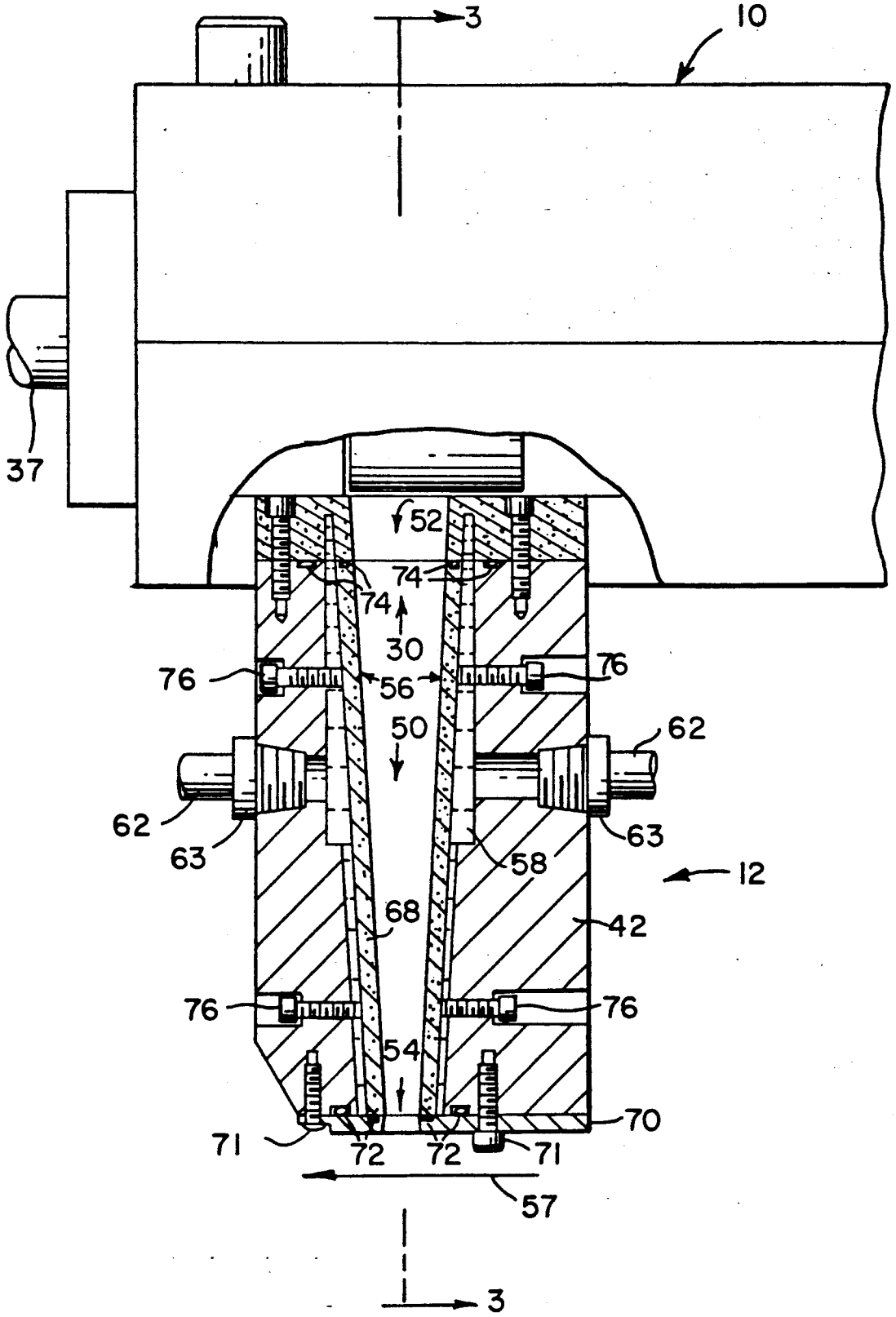
FIG. 2 is a partially broken-away, partially cross-sectional view of a preferred flow orientation apparatus in accordance with the present invention.
Figure 3:
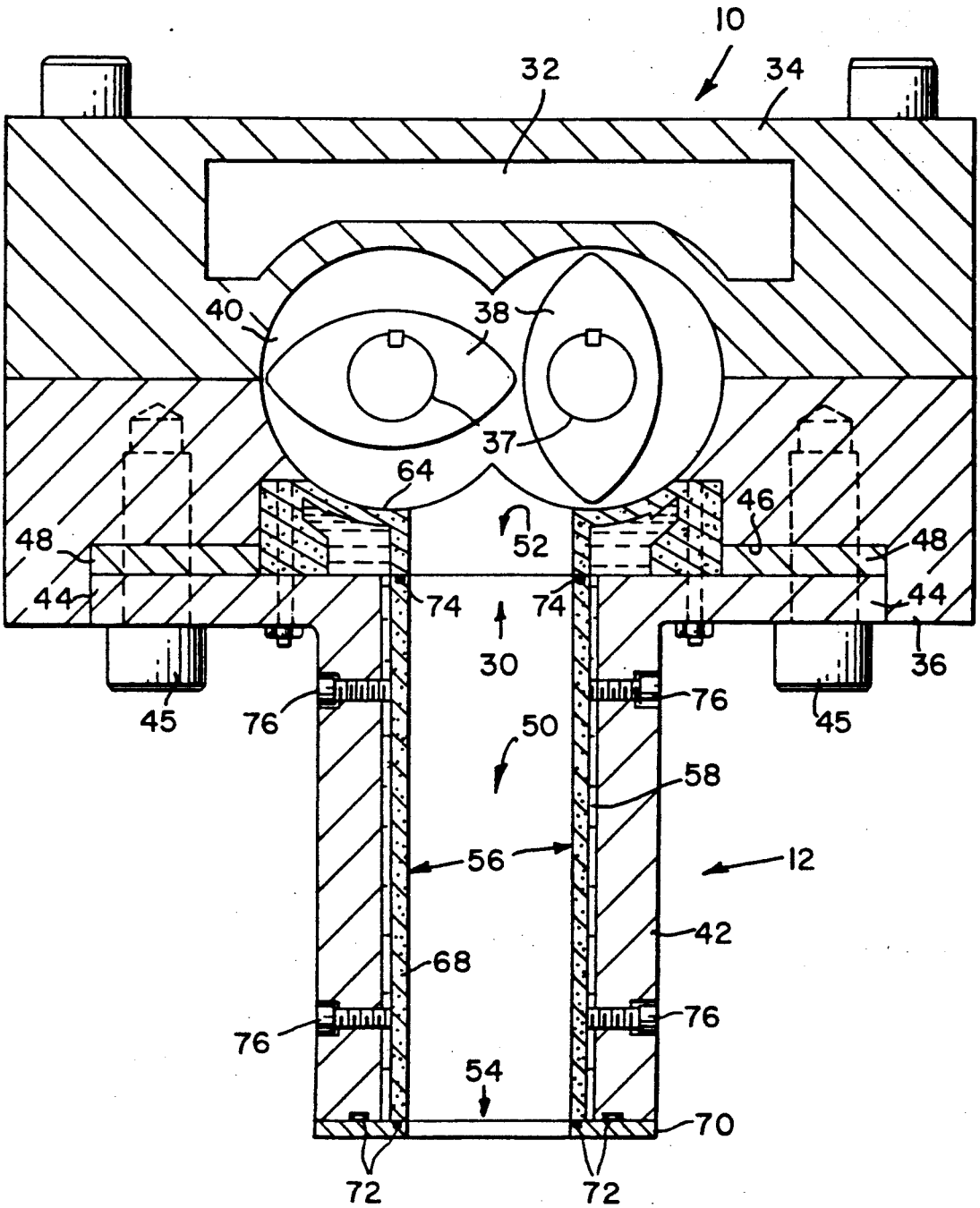
FIG. 3 is a cross-sectional view of the apparatus of FIG. 2 taken along line 3—3.

Referring now to FIGS. 2 and 3, a preferred die (elongational flow orientation apparatus) 12 in accordance with the invention is depicted. The flow orientation apparatus is used with an all surface-wiped, twin screw continuous polymerizer 10 having a downwardly facing discharge opening 30. A motor and gearbox (not shown) drive rotatable screw shafts 37 in the same direction in polymerizer barrel 40 to mix and advance the polymer solution through the polymerizer. The polymerizer 10 has cooling channels (one is identified as 32) so that the temperature of the polymerizer can be appropriately controlled. The polymerizer illustrated has upper and lower housing sections, 34 and 36, respectively, and can be readily disassembled to facilitate cleaning and maintenance. At the discharge opening 30, the screw shafts 37 have self-wiping lobes 38 in the barrel 40 which together with the advancing polymer solution propel the contents of the barrel 40 out of the discharge opening 30. Polymerizers of this type are commercially available such as those manufactured by Teledyne Readco, York, Pa.

The flow orientation apparatus 12 is closely-coupled to the polymerizer 10 and is connected to the lower housing section 36 so that the flow orientation device 12 receives the actively-polymerizing PPD-T solution directly from the barrel 40 of the polymerizer 10. A flow orientation apparatus housing 42 having an upper flanged area 44 as shown in FIG. 3 is attached to the lower housing section 36 by cap screws 45 or other suitable means. Twin-screw polymerizers of the type depicted generally have a recessed area 46 about the discharge opening 30 on the underside of the lower housing section 36 and the flanged areas 44 of the flow orientation apparatus housing 42 can be located in the recess 46. Vertical positioning of the housing in the recess is accomplished with spacers 48 of appropriate thickness.

The elongational flow orientation apparatus 12 provides a flow path 50 having an inlet 52 at the discharge opening 30 of the polymerizer 10 and which decreases in cross-sectional area to an exit 54. The flow path 50 is formed by porous walls 56 which define a rectangular, linearly-decreasing cross-sectional area with the width of the die remaining constant with the thickness decreasing. The flow path of the apparatus shown is intended to be used generally at a 90° angle to the belt 14 (belt direction is indicated by arrow 57). In the die depicted, the thickness decreases by a ratio of about 3 to 1 from the inlet 52 to the exit 54 and the die exit 54 has a width about 5 times greater that the thickness.

The porous walls 56 provide a layer of N-methyl pyrrolidone which exudes through the walls. In the embodiment depicted, this is accomplished by providing an N-methyl pyrrolidone supply enclosure 58 which surrounds the porous walls 56. The enclosure 58 is supplied with N-methyl pyrrolidone by means of supply lines 62 running from a pressurized source of N-methyl pyrrolidone (not shown) which are connected to the housing 42 at fittings 63.

In order to facilitate the construction of the flow orientation apparatus 12 depicted, the porous walls 56 providing the flow path 50 are provided by two porous metal parts. Immediately adjacent the barrel 40 of the polymerizer 10 is a top cap 64 fabricated from 316 stainless steel porous plate stock having 1.0–2.0 micron pore size. The top cap 64 is machined so that its upper surface conforms to the sweep of the lobes 38 of the polymerizer 10 at the discharge opening 30. The interior of the top cap 64 is hollow to provide a somewhat uniform porous wall thickness adjacent to the barrel 40 of the polymerizer 10 and the flow path 50. The hollow area is in fluid communication with the N-methyl pyrrolidine supply enclosure 58.

The second part forms most of the flow path 50 and is provided by rectangular tapering tube member 68 which is of unitary construction of porous 316 stainless steel having a 0.2–1.0 micron pore size. The tube member 68 is supported in the housing 42 between the top cap 64 and a bottom cap 70 having an outwardly tapering opening which registers with the exit 54 of the flow path 50. The bottom cap 70 is attached to the housing 42 by screws 71 or other suitable means. Lower seals 72 are provided in seal recesses to aid in confining the N-methyl pyrrolidone in the supply enclosure 58 formed in the space between the outside of the tube member 68 and the inside of the housing 42. Upper seals 74 similarly are provided between the top cap 64 and the housing 42 and between the tube member 68 and the top cap 64 to similarly confine the flow of NMP. Contact of the exterior surfaces of the top cap 64 with the recessed areas of the lower housing section 36 of the polymerizer 10 aids in preventing leakage from the porous metal of the top cap. Set screws 76 having nylon tips are provided in the housing 42 to adjust and secure the position of the tube member 68.

Referring again to FIG. 1, the resulting elongated, oriented anisotropic liquid solution strip (not shown) issuing from the die 12 is deposited onto conveyer belt 14. At the time the liquid solution is deposited on the belt, the viscosity is sufficiently high that the orientation of the deposited solution is not lost before the solution gels. On the belt 14, the elongated strip of solution is incubated at an elevated temperature sufficiently long for the solution to gel into a hard gel before it reaches the cutter 16. The cutter 16 cuts the hard gel into pieces (not shown) having the desired length intervals and the pieces then drop into bins in a bin conveyer 18 for continued incubation.

When the inherent viscosity of the para-aramid in the gel pieces has reached the desired level in the bin conveyer 18, the gel is discharged into a pug mill 20 containing a dilute caustic soda solution. In the pug mill 20, the gel is size-reduced and simultaneously neutralized and coagulated. The resulting pulp slurry is then transferred to a Reitz refiner 22 for further size-reduction. The pulp slurry is stored under agitation in a slurry tank 24 and is continuously drawn off onto an isolation belt 26 for washing. The pulp wet cake is then dewatered for wet packaging and/or dried and shredded for dry packaging at a pulp consolidation station 28. Solvent in the caustic solution and the wash water is recovered for reuse.

The pulp produced by the process in accordance with the invention consists essentially of short fibrillated fibers of para-aramid, preferably p-phenylene terephthalamide, comprising bundles of sub-micron diameter fibrils having an inherent viscosity between about 2.0 and 4.5. Since the method does not involve spinning from a sulfuric acid solution, the para-aramid is free of sulfonic acid groups. The diameter of the pulp-like fibers produced in this process range from less than 1 micron to about 150 microns. The length of pulp-like fibers produced in this process range from about 0.2 mm to about 35 mm, but never exceed the interval of the transversely cut gel. The crystallinity index as measured by x-ray diffraction is less than 50 and the crystallite size is less than about 40 Å. The pulp is also characterized by fibrils having a wavy, articulated structure. Surface area of this product measured by gas adsorption methods is greater than about 2 $m^2/g$ versus that of an equivalent amount of unpulped, spun fiber of less than 0.1 $m^2/g$ indicating a high level of fibrillation. It is believed that the pulp fibers are more fibrillated along their length than pulp produced from spun fiber and can adhere more securely to a matrix material in such applications. When the pulp is not dried to below about 30% water based on the weight of the dry pulp ("never-dried"), the pulp fiber has an uncollapsed structure which is not available in pulp produced from spun fiber.

The product when used in end-use applications, such as friction products and gaskets, surprisingly provides equivalent performance to pulp made by conventional techniques, i.e., cutting and refining of spun fiber even though the inherent viscosity is lower than commercial pulp produced from spun fiber.

The examples which follow illustrate the invention employing the following test methods.

Test Methods

Inherent Viscosity

Inherent Viscosity (IV) is defined by the equation:

$$IV = \ln(\eta rel)/c$$

where c is the concentration (0.5 gram of polymer in 100 ml of solvent) of the polymer solution and $\eta$rel (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$).

Crystallinity Index and Apparent Crystallite Size

Crystallinity Index and Apparent Crystallite Size for poly-p-phenylene terephthalamide pulp are derived from X-ray diffraction scans of the pulp materials. The diffraction pattern of poly-p-phenylene terephthalamide is characterized by equatorial X-ray reflections with peaks occurring at about 20° and 23° (2$\theta$).

As crystallinity increases, the relative overlap of these peaks decreases as the intensity of the peaks increases. The Crystallinity Index (CI) of poly-p-phenylene terephthalamide is defined as the ratio of the difference between the intensity values of the peak at about 23° 2$\theta$ and the minimum of the valley between the peaks at about 22° 2$\theta$, to the peak intensity at about 23° 2$\theta$, expressed as percent. Crystallinity Index is an empirical value and must not be interpreted as percent crystallinity.

The Crystallinity Index is calculated from the following formula:

$$\text{Crystallinity Index} = \frac{(A - C) \times 100}{A - D}$$

where

A = Peak at about 23° 2$\theta$

C = Minimum of valley at about 22° 2$\theta$, and

D = Baseline at about 23° 2$\theta$.

Apparent Crystallite Size is calculated from measurements of the half-height peak width of the equatorial diffraction peaks at about 20° and 23° (2$\theta$). The Primary Apparent Crystallite Size refers to the crystallite size measured from the primary, or lower 2$\theta$ scattering angle, at about 20° (2$\theta$).

Because the two equatorial peaks overlap, the measurement of the half-height peak width is based on the half-width at half-height. For the 20° peak, the position of the half-maximum peak height is calculated and the 2$\theta$ value for this intensity measured on the low angle side. The difference between this 2$\theta$ value and the 2$\theta$ value at maximum peak height is multiplied by two to give the half-height peak (or "line") width.

In this measurement, correction is made only for instrumental broadening; all other broadening effects are assumed to be a result of crystallite size. If 'B' is the measured line width of the sample, the corrected line width $\beta$ is $$\beta = \sqrt{B^2 - b^2}$$

where 'b' is the instrumental broadening constant. 'b' is determined by measuring the line width of the peak located at approximately 28° 2$\theta$ in the diffraction pattern of a silicon crystal powder sample.

The Apparent Crystallite Size is given by $$ACS = (K\lambda)/(\beta \cos \theta),$$

wherein

K is taken as one (unity)

$\lambda$ is the X-ray wavelength (here 1.5418 Å)

$\beta$ is the corrected line breadth in radians $\theta$ is half the Bragg angle (half of the 2$\theta$ value of the selected peak, as obtained from the diffraction pattern).

In both Crystallinity Index and Apparent Crystallite Size measurements, the diffraction data are processed by a computer program that smoothes the data, determines the baseline, peak locations and heights, and valley locations and heights.

X-ray diffraction patterns of pulp samples are obtained with an X-ray diffractometer (Philips Electronic Instruments; ct. no. PW1075/00) in reflection mode. Intensity data are measured with a rate meter and recorded by a computerized data collection/reduction system. Diffraction patterns are obtained using the instrumental settings:

Scanning Speed 1° 2$\theta$ per minute;

Stepping Increment 0.025° 2$\theta$;

Scan Range 6° to 38°, 2$\theta$; and

Pulse Height Analyzer, "Differential".

Surface Area

Surface areas are determined utilizing a BET nitrogen absorption method using a Strohlein surface area meter, Standard Instrumentation, Inc., Charleston, W. Va. Washed samples of pulp are dried in a tared sample flask, weighed and placed on the apparatus. Nitrogen is absorbed at liquid nitrogen temperature. Adsorption is measured by the pressure difference between sample and reference flasks (manometer readings) and specific surface area is calculated from the manometer readings, the barometric pressure and the sample weight.

Length and Diameter Measurements

About 5 milligrams of dried and loosened pulp is teased and spread out. The fiber lengths and diameters are measured using a 12 power magnifying glass with a precision millimeter reticle, with 0.05 mm lines. Resolution is 0.01 mm.

EXAMPLE 1

This example describes the preparation of poly(p-phenylene terephthalamide) pulp in an NMP-$CaCl_2$ solvent using a laboratory scale apparatus employing batch polymerization and a couette cylinder apparatus for flow orientation. The polymer concentration is 9% by weight and the concentration of $CaCl_2$ is 5.9% based on the total solution weight.

A solution of calcium chloride (65.8 grams; 0.593 moles) in anhydrous N-methyl pyrrolidone (900 ml) is prepared by stirring and heating at 85° C. to dissolve the calcium chloride. After cooling the solution to 25° C. in a round-bottom flask with an overhead stirrer and a dry nitrogen purge, 45.81 grams (0.4236 moles) of p-phenylenediamine is added with mixing and the resulting solution is cooled to 10° C. Anhydrous terephthaloyl chloride (TCl) (43.0 grams 0.2118 moles) is added with stirring causing a temperature rise to 42.1° C. The solution is cooled to 10° C. and the remainder of the TCl (43.00 grams; 0.2118 moles) is added with vigorous mixing giving an adiabatic heat increase of about 12° C. Vigorous mixing is continued as polymerization continues.

When the still polymerizing mixture is translucent when quiescent and opalescent when stirred [inherent viscosity of the poly(p-phenylene terephthalamide) in the mixture is greater than about 1.5], mixing is stopped and the solution is transferred to a couette cylinder apparatus. The couette cylinder apparatus includes an outer tube (inner diameter of 4 inches) and a coaxial inner cylinder and provides an annulus between the outer tube and inner cylinder having a capacity of about 600 cc with a thickness of about ⅝ inch. The annulus is equipped with a nitrogen purge and dry nitrogen is supplied to the annulus. The outer tube is provided with a water jacket to control the temperature of the solution in the annulus and the temperature is adjusted to about 30° C. The inner cylinder is rotated at 205 rpm to subject the solution to shear which is calculated to be an mean shear of 60 $sec^{-1}$ with a shear at the inner surface being 81.5 $sec^{-1}$ and at the outer surface 38.5 $sec^{-1}$. When the viscosity reaches about 200 poise, (calculated from the torque increase on the rotor of the couette apparatus) the movement of the inner cylinder is discontinued.

The water temperature in the water jacket of the couette is increased from 30° C. to 50° C. and the solution incubated at this temperature for 90 minutes. The gel is removed from the couette and is cut into six rings all of roughly equal size at different elevations in the couette (T1-B2 from top to bottom). Each ring was then cut into ¼" pieces with the cut being transverse to the direction of rotation in the couette cylinder.

Pulp is isolated from the gel by mixing the gel pieces with 5% sodium bicarbonate solution (sufficient gel to produce 10 grams dry pulp and 500 ml bicarbonate solution) in a Waring Blendor (about 1800 rpm) for 12 minutes. The pulp material is then dewatered by vacuum filtration. The pulp is then washed twice with water in the Blendor, followed each time by dewatering. The pulp prepared from each of the six rings consists of fine, very fibrillated fibers which have the properties listed in Table 1.

TABLE 1

| | Pulp Properties | | | |
|---|---|---|---|---|
| Sample | Inherent Viscosity | Diameter (mm) | Length (mm) | Surface Area $m^2/g$ |
| T1 | 4.40 | .03-.15 | 2-7 | 5.2 |
| T2 | 4.34 | .03-.15 | 2-7 | 5.2 |
| M1 | 4.42 | .03-.15 | 2-7 | 5.2 |
| M2 | 4.65 | .03-.15 | 2-7 | 5.2 |
| B1 | 4.36 | .03-.15 | 2-7 | 5.2 |
| B2 | 4.36 | .03-.15 | 2-7 | 5.2 |

A standard brake mix is prepared with the following composition and molded into ½ inch molded brake bars at 180° C. for 40 minutes:

50% 200 mesh dolomite
15.2% Barium Sulfate (BARMITE XF)
15.2% CARDOLITE 104-40
15.2% CARDOLITE 126
3.8% Pulp (Pooled from samples T1-B2)

Flex strength is measured at room temperature and at 350° F. with the following results:

5660 psi at room temperature
3280 psi at 350° F.

Control brake bars of the same composition containing commercially available pulp from spun fiber sold under the trademark Kevlar® by E. I. Du Pont de Nemours & Co. give the following flex strength values:

6020 psi at room temperature
1920 psi at 350° F.

EXAMPLE 2

The procedures and apparatus as set forth in Example 1 are used to produce pulp having the properties set forth in Table 2 except that the rings T1-B2 are not cut into about ¼ pieces and instead each are cut into several pieces several inches long.

TABLE 2

| | | Pulp Properties | | | |
|---|---|---|---|---|---|
| Sample Number | Inherent Viscosity | Diameter (mm) | Length (mm) | CI | ACS (Å) |
| T1 | 3.46 | .01-.10 | 5-20 | 36 | 32 |
| T2 | 2.90 | .01-.10 | 5-20 | 36 | 32 |
| M1 | 3.25 | .01-.10 | 5-20 | 36 | 32 |
| M2 | 3.33 | .01-.10 | 5-20 | 36 | 32 |
| B1 | 3.33 | .01-.10 | 5-20 | 36 | 32 |
| B2 | 3.30 | .01-.10 | 5-20 | 36 | 32 |

EXAMPLE 3

This Example describes the preparation of poly(p-phenylene terephthalamide) pulp in an NMP-$CaCl_2$ solvent using a laboratory scale apparatus employing batch polymerization and semi-continuous extrusion. The polymer concentration is 10% by weight and the concentration of $CaCl_2$ is 6.5% calculated on the total solution weight.

A solution of calcium chloride (42 g; 0.38 moles) in anhydrous N-methyl pyrrolidone (500 ml) is prepared by stirring and heating at 90° C. After cooling the solution to 25° C. in a round-bottom flask with an overhead stirrer and a dry nitrogen purge, 29.3 g. (0.271 moles) of p-phenylene diamine is added with mixing and the resulting solution was cooled to 10° C. Anhydrous terephthaloyl chloride (TCl) (27.5 g; 0.136 moles) is added with stirring causing a temperature rise to 47° C. After dissolution of the TCl, the solution is cooled to 0° C. and the remaining amount of TCl (27.5 g.; 0.136 moles) is added with vigorous mixing until dissolved. Vigorous mixing is continued during the resulting polymerization.

When the still polymerizing mixture is translucent when quiescent and opalescent when stirred [inherent viscosity of the poly(p-phenylene terephthalamide) in the mixture was greater than about 1.5], the solution is flow oriented by pumping from the round bottom flask at a flow rate of about 2.75 cc/sec. through a die with a linear flow path 4 cm wide, 4 mm thick and 45 cm long to form an elongated mass of an optically anisotropic viscous liquid. Shear rates in the die range from 0 $sec^{-1}$ at the central plane of the flow path to a maximum of about 30 $sec^{-1}$ at the walls of the die (mean shear about 15 $sec^{-1}$). The temperature of the die is maintained at about 25° C. The exit of the die is about 0.6 cm above a moving horizontal belt blanketed in dry heated nitrogen heated to about 50° C. and the oriented anisotropic liquid solution is deposited on the belt for incubation. The belt has a maximum travel distance of about 45 cm. The die is inclined in relation to the belt so that an angle of 115° is formed between the die and the belt moving away from the die. The extrusion velocity and belt speed were both maintained at about 1.7 cm/sec. The width of the belt is the same as the width of the die (4 cm) and has raised edges to keep the solution from flowing in a direction perpendicular to the direction of movement of the belt. The thickness of the solution on the belt is about 3 mm. The viscosity of the extruded solution is estimated to be about 200–300 poise. The belt and extrusion are stopped when the end of the belt is reached.

Solution is maintained on the belt for incubation for about 90 minutes under a heated nitrogen atmosphere (55° C.) until it becomes a hard gel and so that the reaction continues in the gel to achieve the desired inherent viscosity. After incubation, the gel is cut transversely into two pieces identified as "L1" and "L2" in the Table 3 below with L1 indicating the portion of the gel which was extruded first. Each piece is then further cut into several pieces several inches long for isolation of pulp.

Pulp is isolated from the fully incubated and hardened gel pieces in the following sequence. The gel pieces are mixed with 5% sodium bicarbonate solution (sufficient gel to produce 10 grams dry pulp and 500 ml bicarbonate solution) in a Waring Blendor at high speed (about 1800 rpm) for 12 minutes. The pulp material so isolated was dewatered by vacuum filtration. The pulp is washed twice with hot water in the Blendor, followed each time by dewatering. The pulp so prepared consists of fine, very fibrillated fibers and has the properties indicated in Table 3.

TABLE 3

| | Pulp Properties | |
|---|---|---|
| | L1 | L2 |
| Inherent Viscosity | 3.55 | 3.45 |
| Diameter of Fibers (mm) | .02–.15 | .02–.15 |
| Length of Fibers (mm) | 2–12 | 2–12 |
| Surface Area ($m^2/g$) | 7.1 | 7.1 |

The pulp is incorporated into standard brake mix, molded into bars and is tested in accordance with the procedures of Example I to yield the following flex strength values:

5314 psi at room temperature
1854 psi at 350° F.

EXAMPLE 4

This Example describes the preparation of poly(p-phenylene terephthalamide) pulp in an NMP-$CaCl_2$ solvent using the same apparatus as in Example 3 for batch polymerization and semi-continuous extrusion. The gel pieces L1 and L2 after incubation are cut into strips ¼ inch wide at a 90° angle to the length of the gel before pulp isolation. The polymer concentration is 7% by weight and the concentration of $CaCl_2$ is 3.8% by total solution weight.

A solution of calcium chloride (24.30 g; 0.22 moles) in anhydrous N-methyl pyrrolidone (540 ml) is prepared by stirring and heating at 75° C. After cooling the solution to 25° C. in a round-bottom flask with an overhead stirrer and a dry nitrogen purge, 20.24 g. (0.1872 moles) of p-phenylene diamine is added with mixing and the resulting solution was cooled to 10° C. Anhydrous terephthaloyl chloride (TCl) (19.00 g; 0.0936 moles) is added with stirring causing a temperature rise to 35.3° C. After dissolution of the TCl, the solution is cooled to 5° C. and the second aliquot of TCl (19.00 g; 0.0936 moles) is added with vigorous mixing until dissolved. Vigorous mixing is continued during the resulting polymerization.

When the still polymerizing mixture is translucent when quiescent and opalescent when stirred [inherent viscosity of the poly(p-phenylene terephthalamide) in the mixture was greater than about 1.5], the solution is flow oriented by pumping from the round bottom flask at a flow rate of about 1.85 cc/sec. through a die with a linear flow path 4 cm wide, 4 mm thick and 45 cm long to form an elongated mass of an optically anisotropic viscous liquid. Shear rates in the die range from 0 $sec^{-1}$ at the central plane of the die flow path to a maximum of about 30 $sec^{-1}$ at the walls of the die (mean shear 15 $sec^{-1}$). The temperature of the die is maintained at about 25° C. The exit of the die is about 0.6 cm above a moving horizontal belt blanketed in dry heated nitrogen heated to above about 45° C. and the oriented anisotropic liquid solution is deposited on the belt for incubation. The belt has a maximum travel of about 45 cm. The die is inclined in relation to the belt so that an angle of 115° is formed between the die and the belt moving away from the die. The extrusion velocity is estimated to be about 1.25 cm/sec. and belt speed is maintained at about 1.35 cm/sec. The width of the belt is the same as the width of the die (4 cm) and has raised edges to keep the solution from flowing in a direction perpendicular to the direction of movement of the belt. The viscosity of the extruded solution is estimated to be about 300 poise. The thickness of the solution on the belt is about 2–4 mm. The belt and extrusion are stopped when the end of the belt is reached.

The solution is maintained on the belt for incubation for about 120 minutes under a heated nitrogen atmosphere (45° C.) until it becomes a hard a gel and so that the reaction continues in the gel. The gel is cut into two pieces "L1" and "L2" with L1 indicating the portion of the gel which is extruded first. The gel is then cut into strips about ¼" wide at a 90° angle to the length of the gel.

Pulp is isolated from the fully incubated and hardened gel strips in the following sequence. The gel pieces are mixed with 5% sodium bicarbonate solution (sufficient gel to produce 10 grams dry pulp and 500 ml bicarbonate solution) in a Waring Blendor at high speed (1800 rpm) for 12 minutes. The pulp material so isolated was dewatered by vacuum filtration. The pulp was washed twice with hot water in the Blendor, followed each time by dewatering. The pulp so prepared consists of fine, very fibrillated fibers and has the properties indicated in Table 4.

TABLE 4

| | Pulp Properties | |
|---|---|---|
| | L1 | L2 |
| Inherent Viscosity | 4.42 | 4.48 |
| Diameter of Fibers (mm) | .01–.10 | .01–.10 |
| Length of Fibers (mm) | 1–5 | 1–5 |
| Surface Area ($m^2/g$) | 7.1 | 7.1 |

EXAMPLE 5

This Example describes the preparation of poly(p-phenylene terephthalamide) pulp in an NMP-$CaCl_2$ solvent using the same apparatus as in Example 4 for batch polymerization and semi-continuous extrusion. The procedures of Example 4 are followed except that the gel is cut transversely before continued incubation as described in the following paragraph. The polymer concentration as in Example 4 is 7% by weight and the concentration of $CaCl_2$ is 3.8% by total solution weight.

The solution is maintained on the belt for incubation for about 8 minutes (from time solution is deposited on belt to cutting) under a heated nitrogen atmosphere (50° C.) until it becomes a hard gel. The gel is cut into two pieces "L1" and "L2" and is then cut into strips about ¼" (7 mm) wide at a 90° angle to the length of the gel. So that the reaction continues in the gel, incubation is continued for about 110 minutes at 50° C.

The pulp so prepared consists of fine, very fibrillated fibers and the properties indicated in Table 5.

TABLE 5

| | Pulp Properties | |
|---|---|---|
| | L1 | L2 |
| Inherent Viscosity | 3.06 | 2.72 |
| Diameter of Fibers (mm) | .02-.15 | .02-.15 |
| Length of Fibers (mm) | 1-7 | 1-7 |

EXAMPLE 6

This example discloses a process for preparing poly(p-phenylene terephthalamide) (PPD-T) pulp using an elongational flow orientation apparatus with porous walls providing a layer of N-methyl pyrrolidone on the interior walls forming the flow path to minimize the formation of deposits.

An elongational flow orientation apparatus having a linearly-tapering rectangular flow path comprised of porous metal plates is fitted to the discharge opening of a 5-inch all surface-wiped twin screw polymerizer having a coating jacket but operated without a cooling liquid. The flow orientation apparatus has a vertically downwardly-oriented flow path with an inlet measuring 0.44 inches×1.9 inches for directly receiving material discharged from the polymerizer, a length of about 2.5 inches, and an exit measuring 0.23×1.9 inches. The porous plates forming the walls are 316 stainless steel porous plates about 0.125 inches thick and have a porosity of 0.2-1.0 microns. The plates are supported in a housing with appropriate conduits which supply N-methyl pyrrolidone to the outside surfaces of the plates.

The polymerizer discharges an actively-polymerizing 9.2 wt. % poly(p-phenylene terephthalamide) solution in N-methyl pyrrolidone (NMP) and calcium chloride (molar ratio of $CaCl_2$ to the initial quantity of p-phenylene diamine is 1.38). While still polymerizing, the PPD-T solution is extruded from the flow orientation apparatus at a polymer flow rate of 12.3 pph. The internal surfaces of the porous walls are continuously provided with a layer of NMP which is caused to exude through the porous metal plates at a flow rate of approximately 1.7 ml/sq. in./min. based on the total area of the porous plates in contact with the PPD-T solution. The inherent viscosity of the poly(p-phenylene terephthalamide) in the solution exiting the flow orientation apparatus is approximately 2.3.

The viscous, yet still liquid solution exiting the flow orientation apparatus is periodically collected on a horizontal plate as the plate is moved under the exit at a speed approximately equal to the speed the solution issuing from the flow path exit. The approximately 2 inch wide strip of extruded solution is incubated on the plate at ambient conditions and within about 40 seconds gels to a soft gel. The gel is then cut into ⅜ inch pieces transverse to the flow direction. The cut pieces are then placed in a heater for one hour at approximately 44° C. to further incubate.

To isolate the pulp, the incubated pieces are placed in water in a Waring Blendor and stirred at high speed for several minutes. The pulp is alternately collected on a filter and returned to the Blendor for brief stirring with water five times. The isolated pulp product is composed of highly fibrillated PPD-T pulp with an inherent viscosity of 3.1.

EXAMPLE 7

The same equipment and procedures are used as in Example 6 for solution preparation and extrusion except that the extruded solution is produced at a polymer flow rate of 12.4 pounds per hour and the N-methyl pyrrolidone flow rate is 4.4 ml/sq. in./minute. Polymerization and extrusion are performed for a period of 5 hours. The flow path of the flow orientation device remains largely free of any deposits during the five hour run but with occasional minor partial blockage adjacent to the flow path exit which is easily mechanically dislodged to completely reopen the flow path.

EXAMPLE 8

This example describes the preparation of poly(p-phenylene terephthalamide) pulp in an NMP-$CaCl_2$ solvent using pilot scale continuous production apparatus.

A p-phenylenediamine solution in NMP-$CaCl_2$ at 10° C. containing by weight 5.5% p-phenylenediamine, 7.4% $CaCl_2$, 87.1% NMP and less than 200 ppm water is fed to a mixer and mixed with an amount of molten TCl that is 35% of the stoichiometric amount. The resulting prepolymer is pumped through a heat exchanger to cool the prepolymer to about 5° C. The prepolymer is then mixed with molten TCl at a rate to give a stoichiometric balance between the TCl and diamine in the mixture using apparatus such as is disclosed in U.S. Pat. No. 3,849,074. This mixture is passed continuously through a two inch all surface-wiped, continuous twin screw polymerizer jacketed but operated without a cooling liquid. Quantities of reactants are employed to produce PPD-T at a rate of about 10 lbs per hour.

The liquid solution from the polymerizer flows directly into a closely-coupled flow orientation apparatus then onto a continuous belt for conveying away the extruded material. The flow orientation apparatus and polymerizer is of the type shown in FIGS. 2 and 3 having porous walls defining the elongational flow path, an inlet to the flow path measuring 0.75×1.25 inches, an exit measuring 0.25×1.25 inches and a flow path length of 4.5 inches. N-methyl pyrrolidone is supplied to the flow orientation apparatus at flow rate sufficient to form and maintain a boundary layer between the porous walls and the solution. The belt is 8 inches wide, has a length of about 40 feet, and is generally horizontal. The belt surface is about ½ inch beneath the flow path exit and the angle of the flow path of the flow orientation apparatus in relation to the belt surface is 90° . The entire belt area and the flow orientation apparatus exit is enclosed and is blanketed with nitrogen heated to 45° C. An approximately 1.25 inch wide strip of solution is extruded from the apparatus at a velocity of about 11.7 ft/min and the belt speed is also about 11.7 ft/min.

After traveling on the belt a distance of 35 feet (about 3 minutes) the strip of solution hardens. A guillotine cutter with its stroke ratioed to the belt speed is provided 3 inches from the end of the horizontal surface of the belt and the cutter cuts the gel into about ¼" pieces at a 90° angle to the length of the gel. Pieces of gel reaching the end of the horizontal portion of the belt drop into 5 gallon buckets. The buckets when full are placed in an oven for continued incubation at 45° C. for 60 minutes.

The buckets are removed from the oven on a periodic basis and emptied into a small capacity pug mill (about 25 gal) which is supplied with a dilute caustic solution. Neutralization and coagulation in the pug mill occurs simultaneously with initial size-reduction. The output of the pug mill is continuously supplied to a refiner for further size reduction. The output of the refiner is then fed to a slurry tank holding an approximately 200 gallon volume of slurry under agitation. Slurry from the slurry tank is continuously deposited onto a horizontal filter (length 35 feet and width 17 inches) where the pulp is alternately washed and vacuum dewatered 12 times. The resulting wet cake is then continuously dried in a steam-heated rotory drier.

The pulp prepared consists of fine, very fibrillated pulp having a range of diameters less than 0.15 mm, a length of less than or equal to about 6 mm, and a surface area greater than 4.0 $m^2/g$.

We claim:

1. Para-aramid pulp consisting essentially of pulp-like short fibers comprised of bundles of sub-micron diameter fibrils of para-aramid free of sulfonic acid groups and having an inherent viscosity of between 2.0 and 4.5, having a diameter of between 1μ to 150μ and a length of between 0.2 mm and 35 mm, having a crystallinity index of less than 50, a crystallite size of less than 40 Å, and a surface area of greater than 2 $m^2/g$.

2. The para-aramid pulp of claim 1 wherein the inherent viscosity of said para-aramid is between 3.0 and 4.25.

3. The para-aramid pulp of claim 1 wherein said length is less than 13 mm.

4. Poly(p-phenylene terephthalamide) pulp consisting essentially of pulp-like short fibers comprised of bundles of sub-micron diameter fibrils of poly(p-phenylene terephthalamide) free of sulfonic acid groups and having an inherent viscosity of between 2.0 and 4.5, having a diameter of between 1μ to 150μ and a length of between 0.2 mm and 35 mm, having a crystallinity index of less than 50, a crystallite size of less than 40 Å, and a surface area of greater than 2 $m^2/g$.

5. The para-aramid pulp of claim 4 wherein said length is less than 13 mm.

6. Para-aramid pulp consisting essentially of pulp-like short fibers comprised of bundles of sub-micron diameter fibrils of para-aramid free of sulfonic acid groups and having an inherent viscosity of between 2.0 and 4.5, having a diameter of between 1μ to 150μ and a length of between 0.2 mm and 35 mm, having a crystallinity index of less than 50, a crystallite size of less than 40 Å, and a surface area of greater than 2 $m^2/g$, said fibrils having a wavy, structure and said fibers being fibrillated along the length of the fiber.

7. Para-aramid pulp consisting essentially of pulp-like uncollapsed, never-dried short fibers comprised of bundles of sub-micron diameter fibrils of para-aramid free of sulfonic acid groups and having an inherent viscosity of between 2.0 and 4.5, having a diameter of between 1μ to 150μ and a length of between 0.2 mm and 35 mm, and, when dried, having a crystallinity index of less than 50, a crystallite size of less than 40 Å, and a surface area of greater than 2 $m^2/g$, said short fibers containing at least 30% water based on the weight of the dry fiber.

* * * * *